US007104840B2

(12) United States Patent
Murakami

(10) Patent No.: US 7,104,840 B2
(45) Date of Patent: Sep. 12, 2006

(54) ELECTRICAL CONNECTOR

(75) Inventor: Takao Murakami, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 8 days.

(21) Appl. No.: 10/873,483

(22) Filed: Jun. 23, 2004

(65) Prior Publication Data

US 2004/0266243 A1 Dec. 30, 2004

(30) Foreign Application Priority Data

Jun. 27, 2003 (JP) ..... 2003-184322
Jul. 17, 2003 (JP) ..... 2003-198219

(51) Int. Cl.
*H01R 13/40* (2006.01)
*H01R 13/52* (2006.01)

(52) U.S. Cl. ..... 439/587; 439/272

(58) Field of Classification Search ..... 439/587
See application file for complete search history.

(56) References Cited

U.S. PATENT DOCUMENTS 5,580,264 A * 12/1996 Aoyama et al. ..... 439/587
5,820,400 A * 10/1998 Yamanashi et al. ..... 439/358
6,464,526 B1 10/2002 Seufert et al. ..... 439/352

FOREIGN PATENT DOCUMENTS

DE 101 49 201 C1 6/2003
EP 0 460 727 A1 12/1991
JP 2002-198127 7/2002

* cited by examiner

*Primary Examiner*—Briggitte R. Hammond
(74) *Attorney, Agent, or Firm*—Armstrong, Kratz, Quintos, Hanson & Brooks, LLP

(57) ABSTRACT

A connector has a pair of male and female connector housings 13, 48. The male connector housing 13 has an inner housing 15 that receives a looseness protecting wedge ring 42 having a tapered rear end surface 43*a*. The inner housing 15 also receives a waterproof spring packing 31 abutting against a fore end of the wedge ring 42. The inner housing 15 has an inner surface that engages with the tapered surface 43*a* of the wedge ring 42. On engagement of the connector housings 13 and 48, a fore end of the spring packing 31 is engaged with an inner wall of the female connector housing 48, and the female connector housing 48 is closely engaged with the inner housing 15 via the wedge ring 42. Alternatively, the inner housing 15 that receives inner and outer wedge rings 38, 41 engaged with each other. The inner wedge ring 38 has a tapered surface 39*a* that engages with a tapered surface 43*a* of the outer wedge ring 41.

12 Claims, 9 Drawing Sheets

ELECTRICAL CONNECTOR

BACKGROUND OF THE INVENTION

1. Field of the Invention

The present invention relates to an electrical connector having a pair of connector housings which prevent looseness caused by vibration between the housings during operation of a motor vehicle to ensure electrical connection between male and female terminals in the connector housings.

2. Background Art

FIGS. 10 and 11 show a conventional electrical connector disclosed in Japanese Patent Application laid-open No. 2002-198127. The connector, which is designated by numeral 61, has a male connector 63 accomodating a receptacle terminal 62 and a female connector 65 accomodating a male terminal 70. The male connector 63 has a male connector housing 64 made of a synthetic resin, and the male connector housing 64 has an outer hood 64*b* with an inner surface where looseness preventing protrusions 67 are unitarily formed. Each looseness preventing protrusion 67 engages with an outer surface of a female connector housing 68 for the pin terminal 70 to prevent looseness of the connectors 63 and 65 in a lateral direction of the connector.

The male connector housing 64 has an inner housing 64*a* and the outer hood 64*b* having a rectangular cylinder section. The inner housing 64*a* receives the receptacle terminal 62. The receptacle terminal 62 is double locked by a front holder 69 made of a synthetic resin. The inner housing 64*a* has a base section receiving a packing 71. The looseness preventing protrusion 67 has a generally rectangular shape.

Between the hood 64*b* and the inner housing 64*a*, the female connector housing 68 is inserted. FIG. 11 shows a state just before engagement of the connectors 64 and 68. On mating of the connectors 64 and 68, the terminals 62 and 70 connect to each other. At the same time, a fore end of the female connector housing 68 contacts the packing 71, and a locking arm 72 of the hood 64*b* engages with a locking protrusion 74 of the female connector housing 68 so that the male connector 63 and female connector housing 68 are locked to each other. The protrusion 67 prevents looseness between the inner housing 64*a* of the male connector housing 64 and the front holder 69 in a lateral direction of the connector. This decreases wear of the terminals 62 and 70 which is due to vibration during operation of motor vehicles.

However, the connector 61 prevents looseness in the lateral direction of the connector but does not prevent looseness in a longitudinal direction of the connector. Thus, the terminals 62 and 70 scratch each other between them by vibration of the connector 61 during operation of the vehicle or its engine. This causes disadvantageously friction wear or friction corrosion.

Furthermore, the looseness preventing protrusion 67 is projected from an inner surface of the inner housing 64*a* so that the inner housing 64*a* contact the female connector housing 68 via the looseness preventing protrusion 67 to prevent looseness therebetween. But, the inner housing 64*a* receiving the terminal of the male connector housing 64 does not contact the female connector housing 68. Thus, the looseness of the inner housing 64*a* is not prevented so that the terminals 62 and 70 move toward each other longitudinally, possibly causing wear of the terminals 62 and 70.

In a long use of the connector, the looseness preventing protrusion 67 wears due to vibration during operation of the vehicle to provide a clearance between the hood 64*b* and an outer wall of the female connector housing 68. This may disadvantageously cause looseness even in a lateral direction of the connector.

SUMMARY OF THE INVENTION

In view of the aforementioned disadvantage, an object of the invention is to provide a connector having a pair of male and female connector housings for preventing looseness between the connector housings in lateral and longitudinal directions of the connector, surely eliminating vibration and wear of male and female terminals in the connector housings. The connector can also decrease a cost for changing the female connector in design.

For achieving the object, an electrical connector of a first aspect of the present invention includes:

a first connector housing, a second connector housing mating with the first connector housing, and a looseness inhibiting member mounted to the first connector housing, wherein a tapered surface is provided in at least one of the wall of the first connector housing and a rear end of the looseness inhibiting member, wherein the looseness inhibiting member has a fore end abutting against a wall of the second connector housing to push the looseness inhibiting member inward into the first connector housing so that the wall of the first connector housing and the rear end of the looseness inhibiting member abut against each other at the tapered surface.

In the configuration, on mating of the connector housings, the looseness inhibiting member is pushed by the wall of the second connector housing to move oppositely to the mating direction of the connector housings, so that the looseness inhibiting member abuts longitudinally against the first connector housing at the tapered surface. Thereby, the wall of the first connector housing contacts the wall of the second connector housing via the looseness inhibiting member, so that the pair of connector housings engage with each other without a clearance therebetween in lateral and longitudinal directions of the connector. When each of the wall of the first connector housing and the rear end of the looseness inhibiting member has a tapered surface, the first connector housing abuts against the looseness inhibiting member via the tapered surfaces. This provides an increase engagement area to efficiently prevent looseness of the connector housings. The engagement of the connector housings without a clearance therebetween prevents wear of terminals received in the connector housings and decreases an investment cost for a design change and a new model of the connector. Furthermore, this configuration improves the terminals in connection reliability.

Preferably, the connector of further comprises a resilient member disposed in the first connector housing between the looseness inhibiting member and the second connector housing. In the configuration, on mating of the connector housings, the looseness inhibiting member contacts the wall of the second connector housing via the resilient member to prevent looseness of the connector housings in a longitudinal direction of the connector.

Preferably, a resilient member is disposed in the first connector housing between the looseness inhibiting member and the second connector housing. Thus, on mating of the connector housings, the looseness inhibiting member engages the wall of the second connector housing via the resilient member without a clearance.

Preferably, the resilient member is a sealing packing reinforced with a spring. This configuration enables sealing of the connector housings as well as prevention of looseness of the connector housings.

Preferably, the first connector housing has an inner housing for accommodating a terminal, and the looseness inhibiting member is received in the inner housing. This configuration engages an inner peripheral wall of the inner housing with an outer peripheral wall of the female connector housing via the looseness inhibiting member, preventing effectively wear of the male and female terminals connected to each other in the connector.

Preferably, the resilient member has a protrusion for preventing disengagement of the first and second connector housings. In this configuration, the packing can move inward but can not move forward form the first connector housing, preventing of falling-out of the packing and the looseness inhibiting member. This improves the connector in an assembling process thereof.

Preferably, the looseness inhibiting member has resiliency. In this configuration, the looseness inhibiting member resiliently expands in lateral and longitudinal directions of the connector, absorbing dimension errors of the connector housings formed by injection molding.

Preferably, the looseness inhibiting member comprises a plurality of engagement pieces and a plurality of joining pieces, and each engagement piece has a larger width or a larger thickness than that of each joining piece. In this configuration, the joining piece has a smaller width or a smaller thickness so that the looseness inhibiting member resiliently deforms with ease. Meanwhile, the engagement piece has the larger width or the larger thickness to increase a contact area of the looseness inhibiting member to the inner housing. When the plurality of engagement pieces are connected circumferentially one another so as to contact circumferentially with the connector housings, the engagement pieces prevent looseness of the connector housings uniformly in the circumferential direction and improves the looseness inhibiting member in an assembling process thereof.

An electrical connector of a second aspect according to the present invention includes:

a first connector housing, a second connector housing mating with the first connector housing, and a pair of first and second looseness inhibiting members engaged with each other and mounted in the first connector housing, the first looseness inhibiting member positioned outside the second looseness inhibiting members, wherein a tapered surface is provided in at least one of the first and second looseness inhibiting members, wherein the first looseness inhibiting member has a fore end abutting against a wall of the second connector housing at mating of the first and second connector housings.

In the configuration, at mating of the connector housings, the first looseness inhibiting member is pushed by the wall of the second connector housing to move oppositely to the mating direction of the connector housings, so that one of the first and second looseness inhibiting member rides over the other due to the tapered surface. The one of first and second looseness inhibiting members partially lies over the other. Thereby, the pair of connector housings engage with each other without a clearance therebetween in lateral and longitudinal directions of the connector. This protects the female and male terminals received in the connector housings from wear due to vibration. The second connector housing does not need a tapered surface for the abutment against one of the looseness inhibiting members. Thus, there is no need for design modification of the second connector housing. Therefore, a conventional one can be employed for the second connector, decreasing a cost of parts because of a standardization of the connector housing.

Preferably, the connector further comprises a resilient member disposed in the first connector housing for supporting the second looseness inhibiting member.

In the configuration, at mating of the connector housings, the second looseness inhibiting member moves oppositely to the housing mating direction to be resiliently supported by the resilient member. Thereby, the first and second looseness inhibiting members and the resilient member abut against one another with no clearance to prevent looseness of the connector housings in a longitudinal direction of the connector.

Preferably, the resilient member is a sealing packing reinforced with a spring and is received in the first connector housing. This configuration enables sealing of the connector housings as well as prevention of looseness of the connector housings.

Preferably, the first looseness inhibiting member has a protrusion for preventing its disengagement from the first connector housing. In this configuration, without a stopping member such as a front holder, the packing can move inward but can not move forward form the first connector housing, the first looseness inhibiting member is prevented from its disengagement from the first connector housing. This decreases parts and a manufacturing cost of the connector.

Preferably, the first connector housing has an inner housing for accommodating a terminal, and the first and second looseness inhibiting members are received in the inner housing.

Preferably, the first and second looseness inhibiting members has resiliency. In this configuration, the looseness inhibiting member resiliently expands in lateral and longitudinal directions of the connector, absorbing dimension errors of the connector housings formed by injection molding. Thus, the connector housings engage more closely with each other. This allows easy attachment of the looseness inhibiting member on the first connector housing.

Preferably, each of the looseness inhibiting members comprises a plurality of engagement pieces and a plurality of joining pieces, the engagement pieces joined circumferentially by the joining pieces. This configuration allows an easy, resilient deformation of the looseness inhibiting member so that the looseness inhibiting member is readily mounted in the connector housing. This also prevents disengagement of the looseness inhibiting member during attachment of the inhibiting member. When the plurality of engagement pieces are connected circumferentially one another so as to contact circumferentially with the first connector housing, the looseness inhibiting member prevents looseness of the connector housings with a balance in the circumferential direction. This also prevents disengagement of the looseness inhibiting member during an attachment step of the inhibiting member. The looseness inhibiting member is improved in its attachment step.

DETAILED DESCRIPTION OF THE PREFERRED EMBODIMENTS

Figure 1:
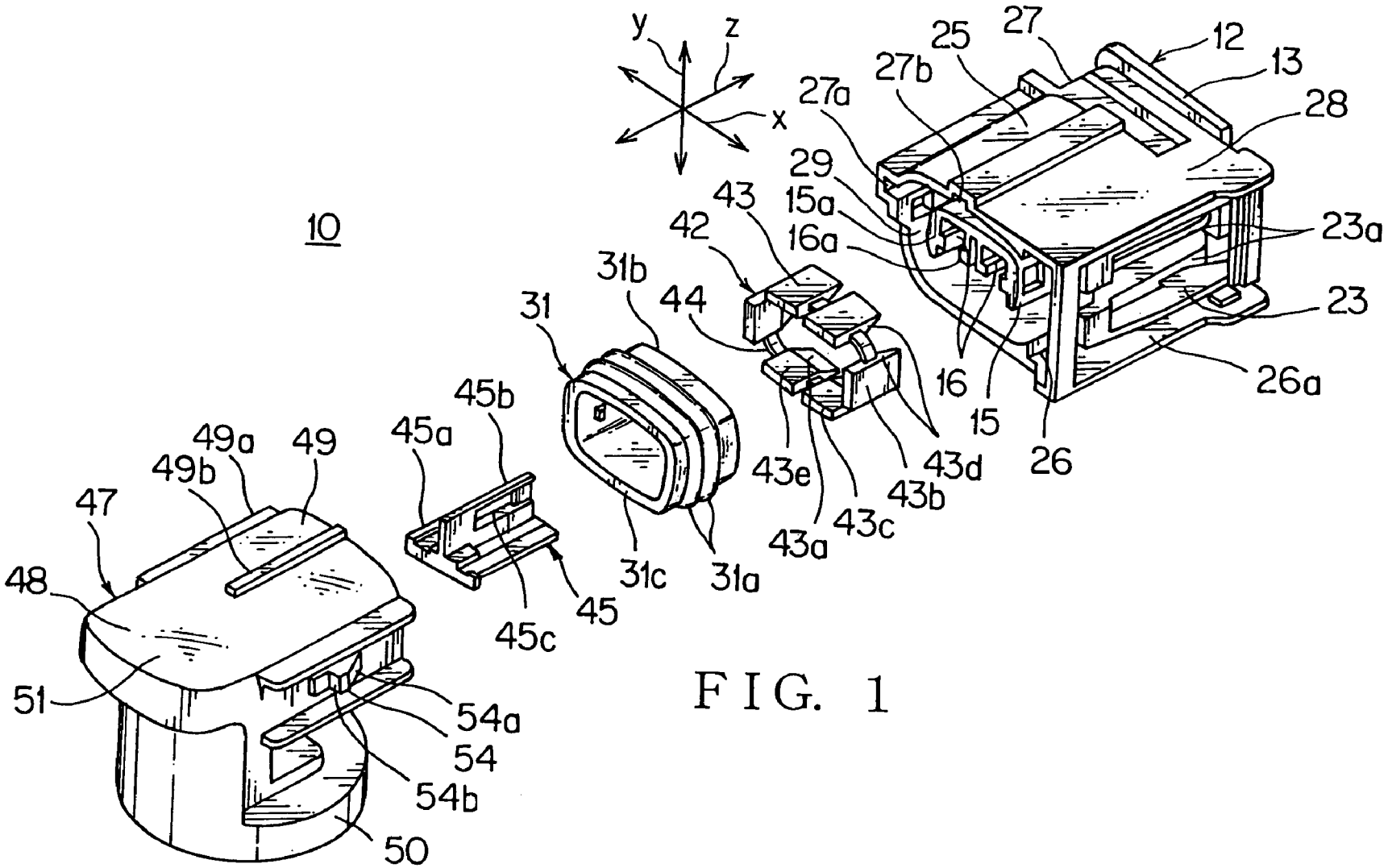
FIG. 1 is an exploded perspective view showing a first embodiment of the present invention.

Referring to the accompanied drawings, embodiments of the present invention will be discussed in detail. FIGS. 1 to 4 show a first embodiment of an electrical connector according to the present invention.

A vibration resisting connector (connector assembly) 10 is a type of electrical parts used in an area receiving vibration such as in a motor vehicle or in an electric instrument. The connector 10 prevents looseness of its connector housings to decrease its vibration due to operation of the motor vehicle or an engine, self vibration of the electric instrument, etc. for improving connection of terminals of the female and male connector housings in reliability.

The connector 10 according to the present invention prevents looseness and decreases vibration of the connector housings in lateral and longitudinal directions of the connector. This surely prevents wear of terminals 35 and 55. The connector 10 does not need modification or a new model of a female connector housing 48. A male connector housing (first connector housing) 13 has an inner housing 15, and the inner housing 15 receives a wedge ring 42 (looseness inhibiting member) and a waterproof spring packing (resilient member) 31 abutting against a fore end of the wedge ring 42. The wedge ring 42 has a tapered surface 43*a* abutting against a tapered surface 24 formed in an inner peripheral wall of the inner housing 15. At mating of the connector housings 13 and 48, a fore end of the spring packing 31 abuts against an inner wall 52*a* of the female connector housing (second connector housing) 48. Thereby, the wedge ring 42 is forced inward so that the tapered surface 43*a* engages with the tapered surface 24 so that the female connector housing 48 engages with the inner housing 15 via the wedge ring 42. This is a basic mating operation of the connector housings.

Figure 2:
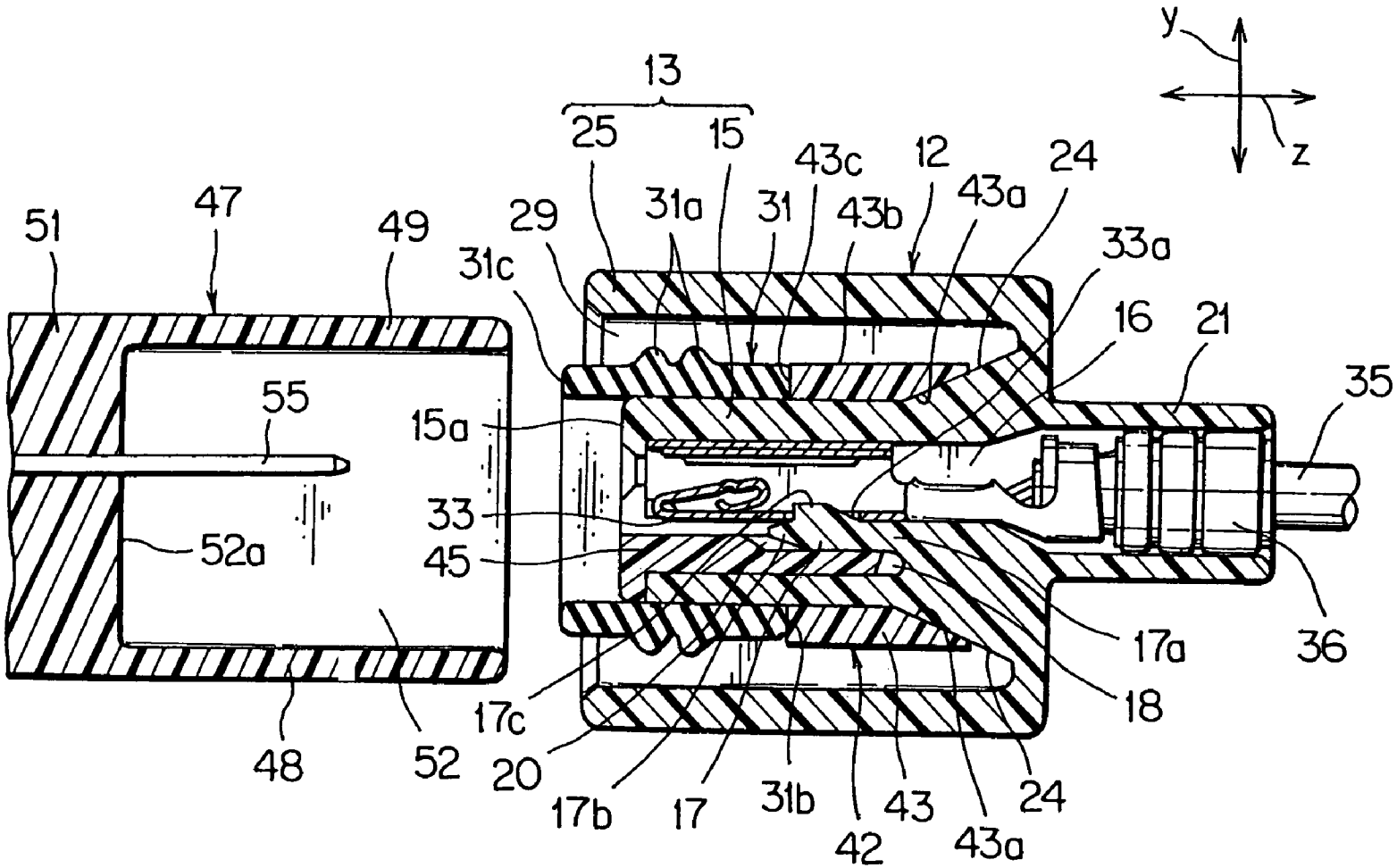
FIG. 2 is a sectional view showing a state before engagement of connector housings of the connector illustrated in FIG. 1.

Next, referring mainly to FIG. 1 and to other drawings, the connector 10 will be discussed in primary configurations and operation of thereof. The connector 10 has a male connector body 12 and a female connector body 47. The male connector body 12 has a male connector housing 13 accomodating a female terminal 33 (FIG. 2), and the female connector body 47 has a female connector housing 48 accomodating a male terminal 55 (FIG. 2).

The male connector body 12 has the male connector housing 13, a wedge ring 42 for prevention of looseness, a spring packing 31 for waterproof, a spacer 45, and the female terminal 33 connected to an electrical cable. The male connector housing 13 is formed by injection molding from a synthetic resin and has an inner housing 15 for receiving a terminal and a hood 25 for covering the inner housing 15.

The inner housing 15 has a generally rectangular section and is formed with two terminal chambers 16 separated by a partition 16*a*. The inner housing 15 also has an insertion opening 20 (FIG. 2) for receiving the spacer 45. Each terminal chamber 16 has a terminal locking lance 17 (FIG. 2) consisting of a base section 17*a* and a free end section 17*b* contiguous with the base section 17*a*. The terminal locking lance 17 is formed with a protrusion 17*c* in its fore end side. The protrusion 17*c* engages with a locking hole 33*a* of the female terminal 33 to lock the female terminal 33. The insertion opening 20 is contiguous with the terminal chamber 16 and a deflection space 18 for the terminal locking lance 17. Complete insertion of the spacer 45 into the insertion opening 20 prevents deflection of the terminal locking lance 17, so that the female terminal 33 is surely locked by the lance 17.

The inner housing 15 has a cylindrical cable leading section 21 (FIG. 2) in its rear half for leading an electrical cable from the terminal chambers 16. The cable leading section 21 receives a waterproof rubber stopper 36 inserted therein for covering the electrical cable 35.

The inner housing 15 has an upper wall formed with a locking arm 23 (FIG. 4) for locking the connector housings 13 and 48. The locking arm 23 has a swing lever supported by its two base portions 23*a* contiguous with the upper wall. The locking arm 23 has the vertical locking surface 23*b* formed near its fore end. The female connector housing 48 has a locking projection 54 engaging with the locking surface 23*b* to lock the connector housings 13 and 48.

In this specification, vertical, lateral, and longitudinal directions are defined as described in the followings. A vertical direction x is parallel to a row of the plurality of female terminals 33, and an upper side is a position where the locking arm 23 is located. A lateral direction y is parallel to a shorter diameter of the elongated circle section of the spring packing 31 (FIG. 1). A longitudinal direction z is parallel to a mating direction of the connector housings, and a fore side is an area where the connector housings mate with each other, while a rear side is an area where the male terminal 55 or the electrical cable 35 is led.

The hood 25 is an outer wall surrounding the inner housing 15. The hood 25 has an upper wall 26 and a protection wall 26*a* extended from the upper wall 26 for protecting the locking arm 23 from external disturbance. The locking arm 23 has a lower wall 27 and a side wall 28 each of which is formed with a guide groove 27*a* or 28*b* associated with a guide rib 49*a* or 49*b* of the female connector housing 48. The guide grooves 27*a* and 28*a* are arranged to position the female connector housing 48 in a vertical direction x and a lateral direction y to allow smooth engagement of the connector housings 13 and 48.

Between the inner housing 15 and the hood 25, there is provided an annular clearance 29. The clearance 29 receives the wedge ring 42 and the spring packing 31, and the circumferential wall 49 of the female connector housing 48 is inserted into the clearance 29.

The wedge ring 42 is a looseness inhibiting member that has a plurality of engagement pieces 43 with joining pieces 44 for joining the engagement pieces. The wedge ring 42 is made of a resin, and each engagement piece 43 has a tapered surface 43*a* inside its rear end section. The wedge ring 42 is movably mounted on an outer wall of the inner housing 15. The wedge ring 42 has a fore end abutting against a rear end of the spring packing 31 to prevent the spring packing 31 from drawing out forward.

One of the engagement pieces 43 is arranged at an upper side and a lower side of the wedge ring 42. Two of the engagement pieces 43 are arranged at a left side and at a right side of the wedge ring 42. The engagement piece 43 has a generally trapezoid section and has a tapered surface 43*a* facing inwardly rearward, an outer contact surface 43*b* contiguous with the tapered surface 43*a*, a vertical fore end surface 43*c* crossing with the outer contact surface 43*b*, side surfaces 43*d*, and an inner contact surface 43*e*. At mating of the connector housings 13 and 48, the tapered surface 43*a* engages with the outward facing tapered surface 24 (FIG. 2) formed in an inner section of the inner housing. This prevents looseness of the connector housings.

The outer contact surface 43*b* contacts an inner peripheral surface of the circumferential wall 49 of the female connector housing 48. The fore end surface 43*c* abuts against a rear end 31*b* of the spring packing 31. Each side surface 43*d* joins to one of the joining pieces 44. The inner contact surface 43*e* has a curvature fit for an outer surface of the inner housing 15.

The joining piece 44 has a width smaller than that of the engagement piece 43 to allow smooth resilient deflection of the wedge ring 42. Thus, the outer contact surface 43*b* of the engagement piece 43 can contact smoothly with an inner peripheral surface of the circumferential wall 49 of the female connector housing 48. Furthermore, the wedge ring 42 is easily attached and prevents drawing-out of itself during the attachment.

Preferably, the wedge ring 42 is made of a soft material to achieve smooth resilient deformation such as a synthetic rubber and an elastomer resin. The molding from such a material of the wedge ring 42 absorbs forming errors so that the tapered surface 43*a* of the wedge ring 42 engages with the tapered surface 24 of the inner housing 15 with no clearance therebetween even when there is an angular error between the tapered surfaces 43*a* and 24. Furthermore, the wedge ring 42 absorbs dimension errors in a radial direction of the wedge ring 42 and deforms in a curved shape along the inner surface of the circumferential wall 49 of the female connector housing 48. This fits the outer contact surface 43*b* of the wedge ring 42 to the inner surface of the circumferential wall 49. Moreover, the wedge ring 42 absorbs vibration (longitudinal and lateral vibration) transmitted from a vehicle body during operation of a vehicle to prevent vibration of the female and male terminals 33, 55 received in the inner housing 15.

The spring packing 31 is a waterproof one formed in an oval tube made of a synthetic rubber or the like. The spring packing 31 is positioned between the wedge ring 42 and the inner wall 52*a* of the female connector housing 48. The wedge ring 42 is mounted in the inner housing 15 so as to partially extend from a fore end surface 15*a* of the inner housing 15 (FIG. 2). The partial extension of a forward section of the spring packing 31 makes the fore end surface 31*c* of the spring packing 31 abut the inner wall 52*a* of the female connector housing 48, so that the wedge ring 42 is forced inward via the spring packing 31.

The spring packing 31 has an outer surface formed with two humps 31*a* closely contacting an inner surface of the circumferential wall 49 of the female connector housing 48. The spring packing 31 has an inner surface formed with a protrusion (locking section) 31*d* (FIG. 4) for preventing disengagement of the spring packing 31. The projection 31*d* is positioned as corresponding to a hole 15*b* of the inner housing 15. The projection 31*d* is located in a side opposite to the humps 31*a* so that the projection 31*d* reliably locks the spring packing 31 when the humps 31*a* are pushed by the circumferential wall 49 of the female connector housing 48.

The spring packing 31 has a rear end 31*b* abutting against the engagement piece 43 of the wedge ring 42. The fore end surface 31*c* of the spring packing 31 abuts against the inner wall 52*a* of the inner housing 15.

The wedge ring 42 and the spring packing 31 are mounted in the inner housing 15, and the connector housings 13 and 48 are engaged with each other. Thereby, the fore end surface 31*c* of the spring packing 31 abuts against the inner wall 52*a* of the female connector housing 48, so that the spring packing 31 is compressed and the two humps 31*a* engage with the circumferential wall 49 of the female connector housing 48. The wedge ring 42 is forced inward by the spring packing 31 to engage with the tapered surface 24 of the wedge ring 42. The tapered surface 24 engages closely with the circumferential wall 49 of the female connector housing 48 via the wedge ring 42. This prevents looseness of the connector housings 13 and 48 in longitudinal and lateral directions so that the female and male terminals 33, 55 are prevented from wearing caused by vibration. When the wedge ring 42 and the spring packing 31 are made of a soft material having a high vibration absorbing performance, the wedge ring 42 decreases vibration in a longitudinal direction of the connector while the spring packing 31 decreases vibration in a lateral direction of the connector. This decreases transmission of external vibration to the female and male terminals 33, 55 received in the inner housing 15.

The female connector body 47 is secured to an electrical instrument (not shown). The female connector housing 48 is constituted by a flange 50 secured to the instrument, a terminal fastening section 51 contiguous to the flange 50, and a rectangular annular circumferential wall 49 contiguous to the terminal fastening section 51. Alternatively, the flange 50 may be may be provided in an associated instrument. The female connector body 47 is constituted by a female connector housing 48 and a male terminal 55 extended in a 52 defined in a fore side of the circumferential wall 49.

Figure 4:
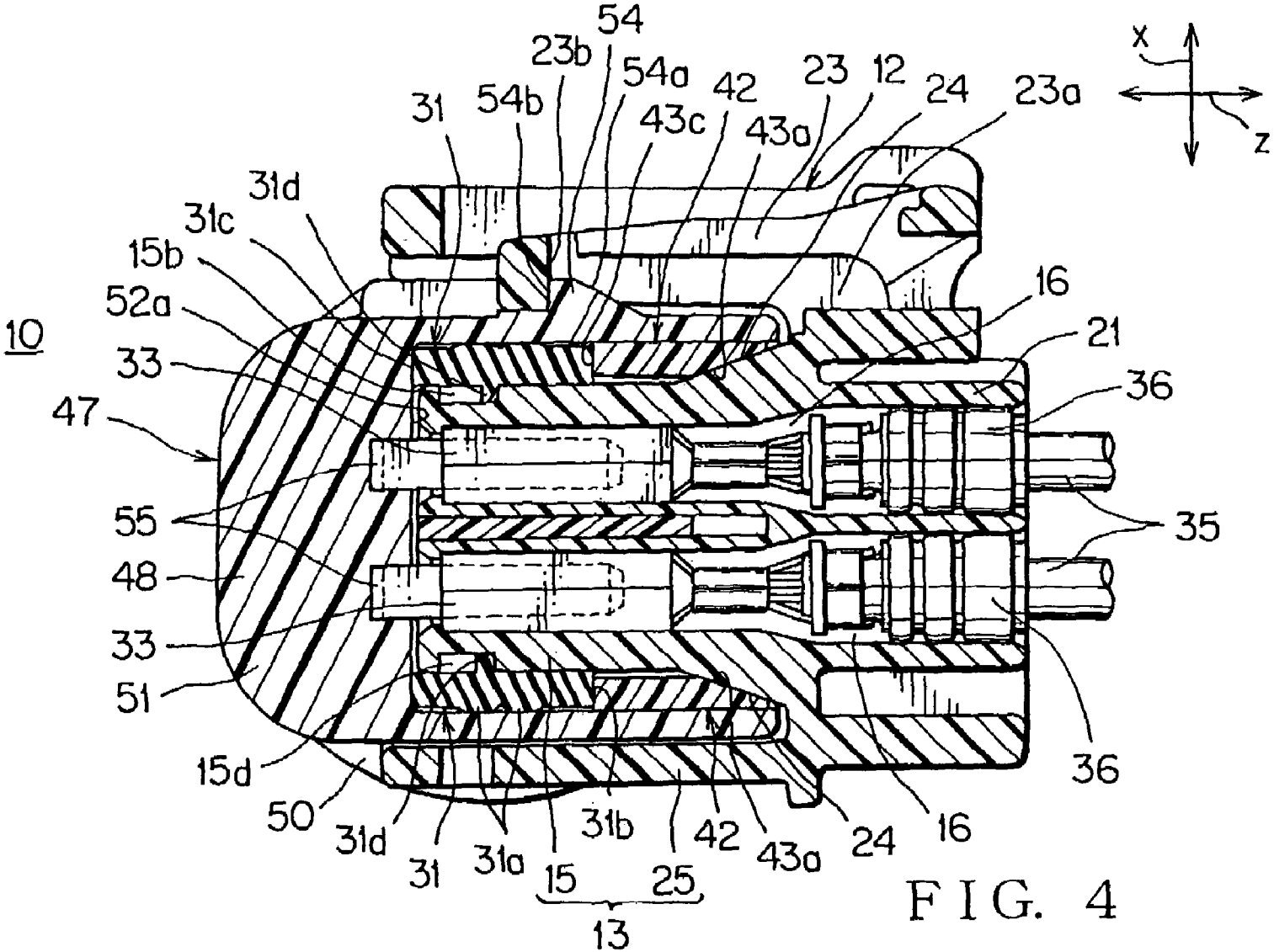
FIG. 4 is a sectional view taken along another direction for showing the state after engagement of the connector housings of the connector.

The circumferential wall 49 has an upper wall formed with a locking projection 54 abutting against the locking surface 23*b* of the locking arm 23. The locking projection 54 has a tapered surface 54*a* and a vertical stopping surface 54*b* contiguous to the tapered surface 54*a* (FIG. 4). Abutment of the vertical stopping surface 54*b* against the locking surface 23*b* of the locking arm 23 engages the connector housings 13 and 48 with each other.

Figure 3:
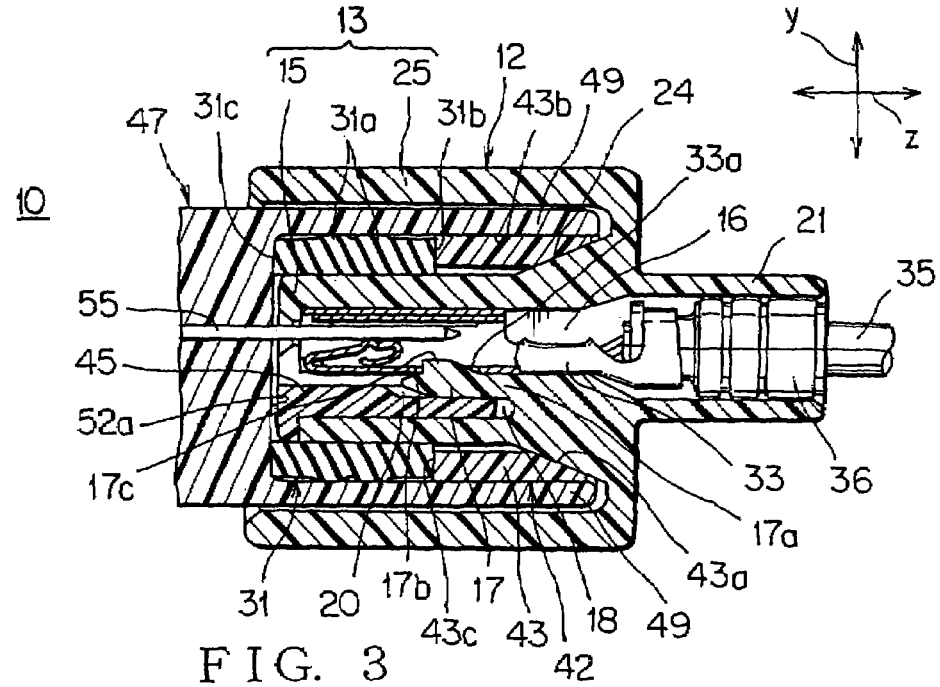
FIG. 3 is a sectional view showing a state after engagement of the connector housings of the connector.

The circumferential wall 49 defines the connector mating space 52 for insertion of the inner housing 15 of the male connector housing 13 (FIGS. 2 and 3). The connector mating space 52 has an inner wall 52*a* abutting against the fore end surface 31*c* of the spring packing 31 partially extended from the fore end surface 15*a* of the inner housing 15.

The female connector body 47 has a conventional female connector housing 48 which is neither a special one nor a new model. This decreases an investment cost to produce the connector.

Next, a process for assembling and coupling of the vibration resisting connector 10 will be discussed. First, as shown in FIG. 2, the wedge ring 42 and the spring packing 31 are assembled sequentially into the inner housing 15 of the male connector housing 13. Then, the spacer 45 is assembled into the inner housing 15, while the inner housing 15 has received the female terminal 33 connected to the electrical cable. With the insertion of the spacer 45, its horizontal wall 45*a* moves forward into the deflection space 18 of the terminal locking lance 17 so that the terminal locking lance 17 is locked to surely prevent drawing-out of the female terminal 33. A vertical wall 45*b* of the spacer 45 has a locking hole 45*c* (FIG. 1) engaging with an inner wall of the insertion opening 20 to prevent disengagement of the spacer 45.

As shown FIGS. 3 and 4, at engagement of the connector housings 23 and 48, the inner housing 15 of the male connector housing 13 is inserted into the connector mating space 52 of the female connector housing 48, and the circumferential wall 49 of the female connector housing 48 moves forward into the generally circumferential clearance 29 defined between the inner housing 15 and the hood 25. Then, the inner wall 52*a* of the connector mating space 52 abuts against the fore end surface 31*c* of the spring packing 31 to push the wedge ring 42 inward, so that the tapered surface 43*a* of the wedge ring 42 abuts against the tapered surface 24 of the inner housing 15. The connector housings 13 and 48 keep their engagement by locking of the locking projection 54 of the female connector housing 48 with the locking arm 23.

In a locking state of the connector housings 13 and 48, the spring packing 31 contacts closely both the inner wall 52*a* of the female connector housing 48 and the wedge ring 42 without a clearance therebetween, while the wedge ring 42 contacts closely both the circumferential wall 49 of the female connector housing 48 and the tapered surface 24 of the inner housing 15 without a clearance therebetween. This prevents looseness of the connector housings in the longitudinal and lateral directions of the connector, preventing wear of the male and female terminals 33 and 55.

This embodiment employs the female connector body 47 that is a connector body directly secured to an instrument, but a conventional wiring harness connector may be used alternatively. Furthermore, The looseness inhibiting member is not limited in a ring shape but may be configured in various shapes.

The embodiment can be modified within the concept of the present invention as follows:

(1) The engagement piece 43 of the wedge ring 42 is modified to have a larger thickness instead of the larger width. Such engagement piece 43 has an operational effect the same as the engagement piece 43 having a larger width, since the tapered surfaces 24 and 43*a* have a larger contact area for each other.

(2) The joining piece 44 of the wedge ring 42 is modified to have a smaller thickness instead of a smaller width. Such a joining piece 44 has an operational effect the same as the joining piece 44 having the smaller width. That is, the wedge ring 42 can resiliently deflect with ease so that the wedge ring 42 contacts more closely with the circumferential wall 49 of the female connector housing 48.

(3) The tapered surface 24 of the inner housing 15 is modified to a shoulder shape. The shoulder has an operational effect the same as the tapered surface 24, and the shoulder is easily formed.

(4) Only one of the inner housing 15 and the wedge ring 42 may have a tapered surface instead of the tapered surfaces 24 and 43*a* of the inner housing 15 and the wedge ring 42. This provides a simplified construction, allowing easy forming and a decreased manufacturing cost.

FIGS. 5 to 9 show a second embodiment of an electrical connector according to the present invention.

A vibration resisting connector (connector assembly) 100 is a type of electrical parts used in an area receiving vibration like the first embodiment.

The connector 100 according to the present invention prevents looseness and decreases vibration of the connector housings in lateral and longitudinal directions of the connector. This surely prevents wear of terminals 35 and 55. The connector 100 does not need a modification or a new model of a female connector housing 48. A male connector housing (first connector housing) 13 has an inner housing 15, and the inner housing 15 receives an inner wedge ring 38 (looseness inhibiting member), an outer wedge ring 41 (looseness inhibiting member), and a waterproof (resilient member) spring packing 31 abutting against the inner wedge ring 38. The inner wedge ring 38 has a tapered surface 39*a* engaging with a tapered surface 43*a* formed in the outer wedge ring 41. The outer wedge ring 41 partially extends from a fore end of the inner housing 15. At mating of the terminals 13 and 48, a fore end 43 of the outer wedge ring 41 abuts against an inner wall 52*a* of the female connector housing (second connector housing) 48.

Furthermore, at least one of the inner and outer wedge rings 38, 41 has resiliency. Each of the looseness inhibiting members comprises a plurality of engagement pieces 39 or 43 and a plurality of joining pieces 40 or 44, the engagement pieces joined circumferentially by the joining pieces. Each engagement piece 39 or 43 has the tapered surface 39*a* or 43*a*, and the tapered surfaces 39*a*, 43*a* engage with each other.

Figure 5:
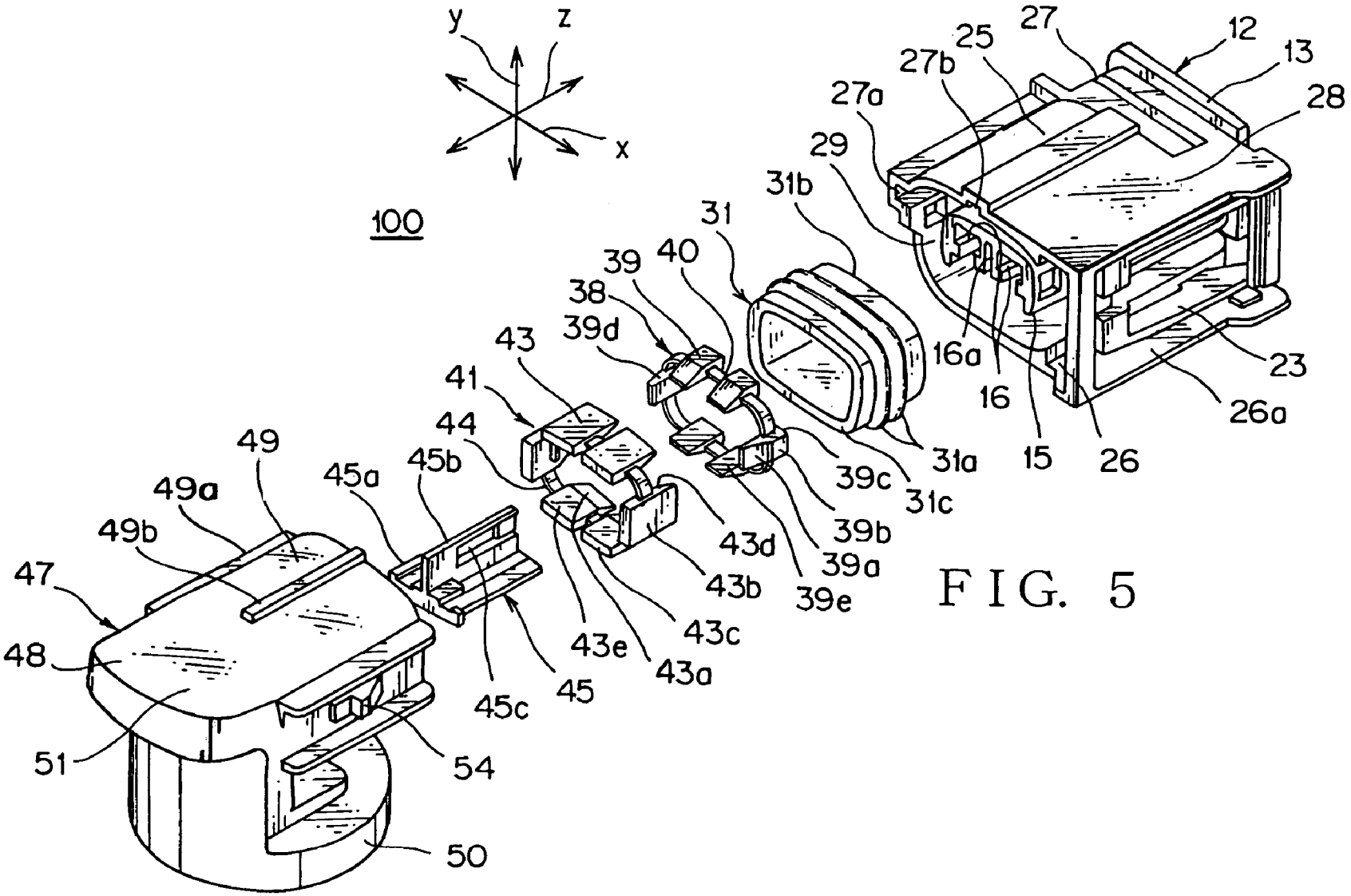
FIG. 5 is an exploded perspective view showing a second embodiment of the present invention.
Figure 8:
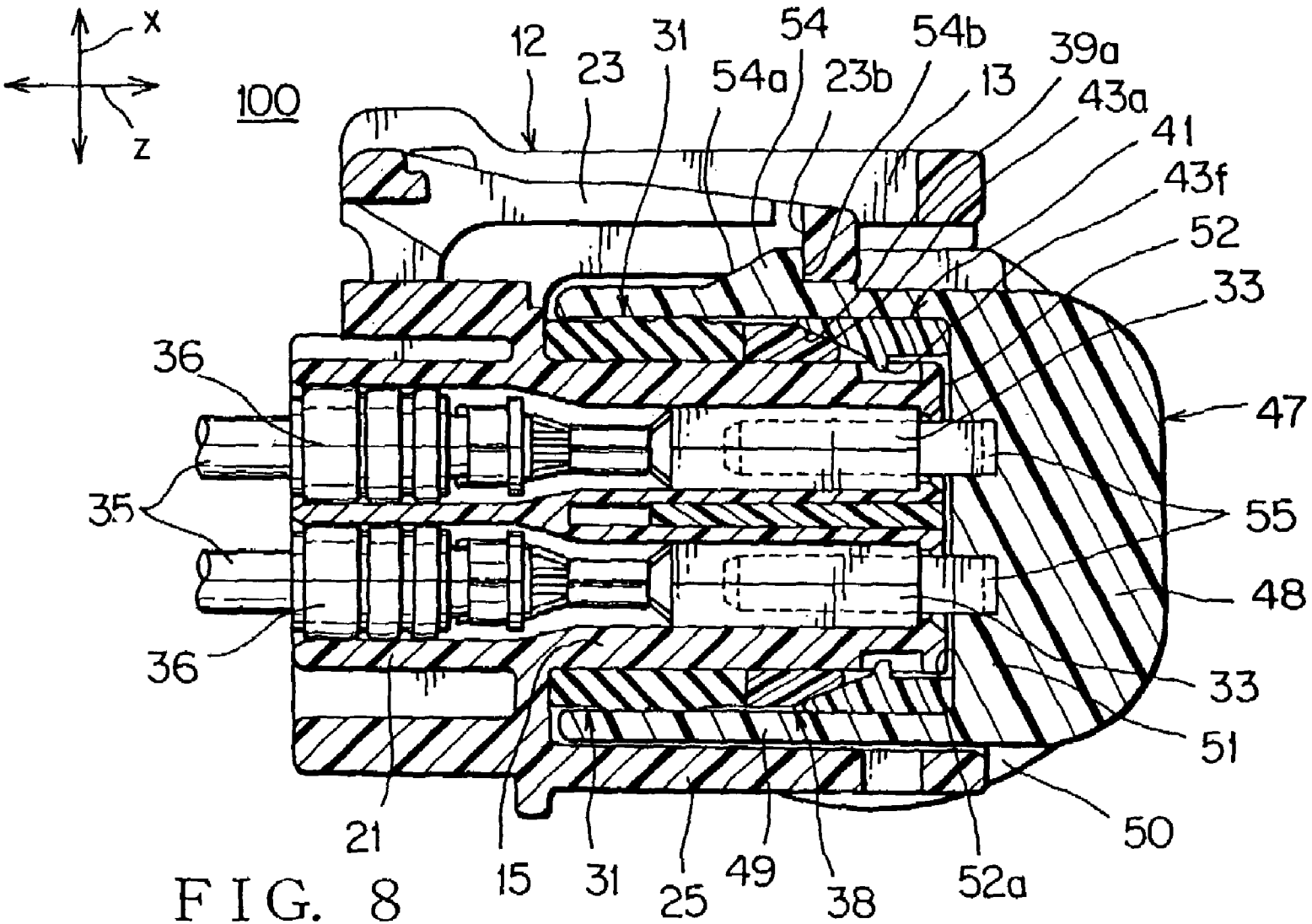
FIG. 8 is a sectional view showing a state after engagement of connector housings of FIG. 5.

Next, referring mainly to FIG. 5 and to other drawings, the connector 100 will be discussed in primary configurations and operation of thereof. The connector 100 has a male connector body 12 and a female connector body 47. The male connector body 12 has a male connector housing 13 accommodating a female terminal 33 (FIG. 8), and the female connector body 47 has a female connector housing 48 accommodating a male terminal 55 (FIG. 8).

The male connector body 12 has the male connector housing 13, the spring packing 31 for waterproof, inner and outer wedge rings 38, 41 for prevention of looseness, a spacer 45, and two female terminals 33 each connected to an electrical cable. The male connector housing 13 is formed by injection molding from a synthetic resin and has an inner housing 15 for receiving a terminal and a hood 25 outwardly covering the inner housing 15.

The inner housing 15, terminal chambers 16, and the hood 25 are configured in the same way as that of the first embodiment, which will not be discussed again.

Figure 7:
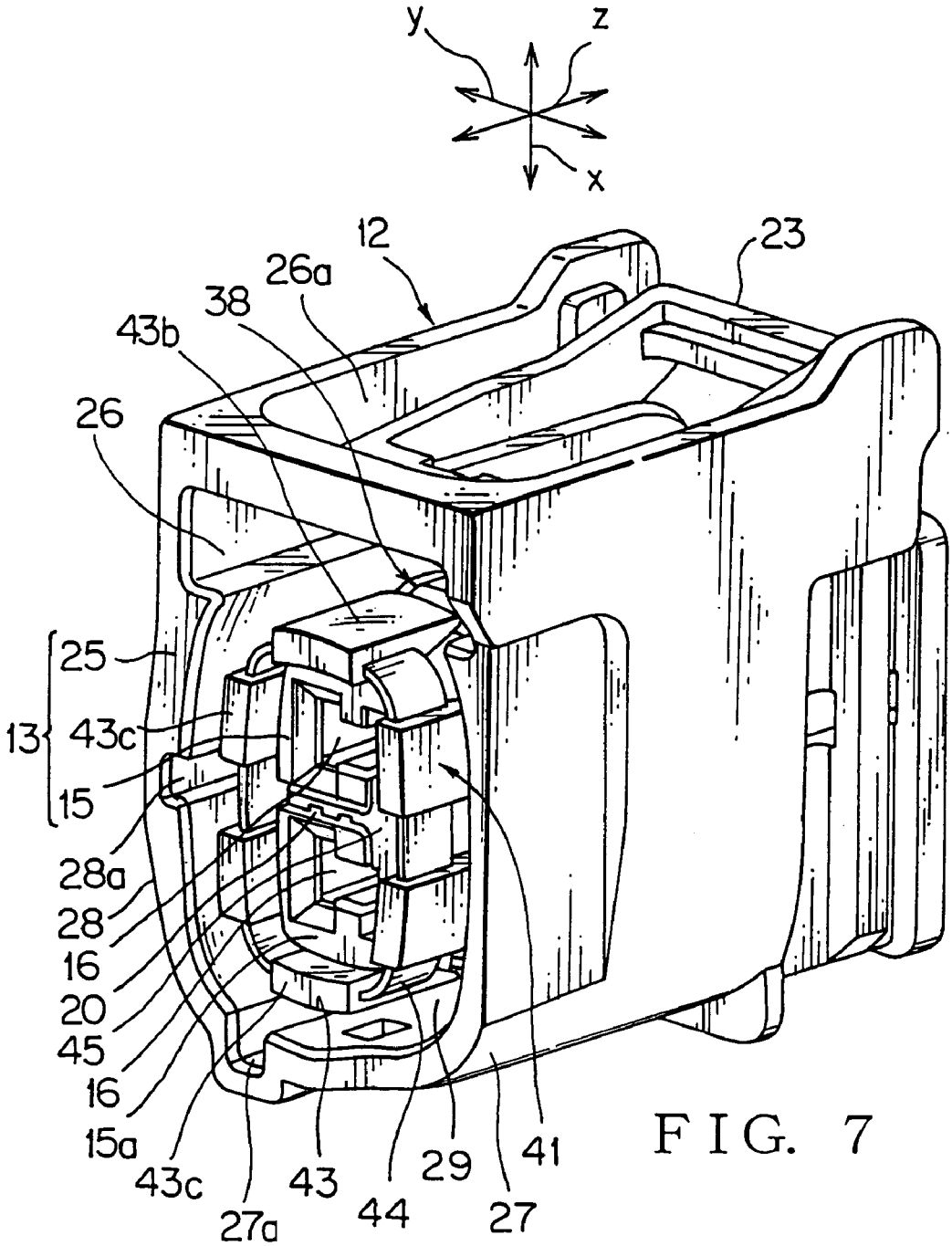
FIG. 7 is a sectional view showing the male connector housing of FIG. 6.

As shown in FIG. 7, between the inner housing 15 and the hood 25, there is provided an annular clearance 29. The clearance 29 receives the female connector housing 48 and the spring packing 31. The circumferential wall 49 of the female connector housing 48 is inserted into the clearance 29. The outer wedge ring 41 is preliminarily disposed to be positioned forward from the inner wedge ring 38 with a gap therebetween. At mating of the connector housings 13, 48, the inner wall 52*a* of the female connector housing 48 forces inward a fore end 43*c* of the outer wedge ring 41. Thereby, the inner and outer wedge rings 38, 41 engage with each other.

The spring packing 31 (FIG. 5) is a waterproof packing made of a synthetic rubber or the like. The spring packing 31 is mounted on an outer peripheral surface of the inner housing 15. The spring packing 31 has an outer surface formed with two protrusions 31*a* closely contacting an inner surface of the circumferential wall 49 of the female connector housing 48. The spring packing 31 has a rear end 31*b* abutting against an inner wall of the inner housing 15 and a fore end 31*c* abutting against a rear end surface 39*c* of the inner wedge ring 38.

Each of the inner and outer wedge rings 38, 41, which is a looseness inhibiting member, is made of a resin. The wedge rings can move on an outer surface of the inner housing 15. The outer wedge ring 41 has an inner contact surface with a protrusion (locking piece) 43*f* (FIGS. 2 and 4) that prevents the ring 42 from disengaging from the inner housing 15. The inner wedge ring 38 is located between the spring packing 31 and the outer wedge ring 41, and the inner wedge ring 38 resiliently abuts against the spring packing 31. The outer wedge ring 41 is positioned outside the inner wedge ring 38 and partially extends from the inner housing 15.

The inner wedge ring 38 has a plurality of engagement pieces 39 each formed with an upper tapered surface 39*a* and a plurality of joining pieces 40 to join the engagement pieces 39. One of the engagement pieces 43 is arranged at an upper side and at a lower side of inner wedge ring 38. Two of the engagement pieces 39 are arranged at a left side and at a right side of the inner wedge ring 38. The engagement piece 39 has a generally trapezoid section and has a tapered surface 39*a* facing outwardly forward, an outer contact surface 39*b* contiguous with the tapered surface 39*a*, the vertical rear end surface 39*c* crossing with the outer contact surface 39*b*, side surfaces 39*d*, and an inner contact surface 39*e*. At mating of the connector housings 13 and 48, the outer wedge ring 41 rides partially over the tapered surface 39*a*. The outer contact surface 39*b* has a curvature fit for an inner peripheral surface of the circumferential wall 49 of the female connector housing 48. The rear end surface 39*c* abuts against the fore end 31*c* of the spring packing 31. Each side surface 39*d* joins to one of the joining pieces 40. The inner contact surface 39*e* has a curvature fit for an outer surface of the inner housing 15.

The joining piece 40 has a width smaller than that of the engagement piece 39 to allow resilient deflection of the inner wedge ring 38. Thus, the engagement piece 39 can contact smoothly with an outer peripheral surface of the inner housing 15. Furthermore, the inner wedge ring 38 is easily mounted in the male connector housing 13 and prevents drawing-out of itself during the attachment.

Similar to the inner wedge ring 38, the outer wedge ring 41 has a plurality of engagement pieces 43 each formed with an upper tapered surface 43*a* and a plurality of joining pieces 44 to join the engagement pieces 43. Each of the engagement pieces 43 corresponds to one of the engagement pieces 39 of the inner wedge ring. The engagement piece 43 has a tapered surface 43*a* facing inward and associated with the outward tapered surface 39*a* of the inner wedge ring 38. The engagement piece 39 has an inner contact surface 43*e* contiguous with the tapered surface 43*e* and a vertical rear end surface 43*c* crossing with the inner contact surface 43*e*. The outer contact surface 43*b* has a curvature fit for an inner peripheral surface of the circumferential wall 49 of the female connector housing 48.

Preferably, the outer wedge ring 41 is made of a soft material such as a synthetic rubber and an elastomer resin to achieve a resilient deformation smoother than the inner wedge ring 38 so that the outer wedge ring 41 can partially ride over the tapered surfaces 39*a* of the inner wedge ring 38. The molding from such a material of the outer wedge ring 41 absorbs forming errors so that the tapered surfaces 39*a*, 43*a* of the wedge rings engage with each other with no clearance therebetween even when there is an angular error between the tapered surfaces 39*a* and 43*a*. Furthermore, the outer wedge ring 41 absorbs dimension errors in a radial direction of the wedge rings and deforms in a curved shape along the inner surface of the circumferential wall 49 of the female connector housing 48. This fits the outer wedge ring 41 to the inner surface of the circumferential wall 49. Moreover, the outer wedge ring 41 absorbs vibration transmitted from a vehicle body during operation of a vehicle.

The inner and outer wedge rings 38, 41 engage with each other, and the connector housings 13 and 48 engage with each other. One of the inner and outer wedge rings 38, 41 partially rides over the other in their thickness direction. This prevents looseness of the connector housings 13 and 48 in longitudinal and lateral directions so that the female and male terminals 33, 55 are prevented from wearing caused by vibration.

The provision of the inner and outer wedge rings 38, 41 eliminates a design modification of the female connector housing 48 for prevention of looseness, allowing a standardization of the female connector housing 48.

Figure 6:
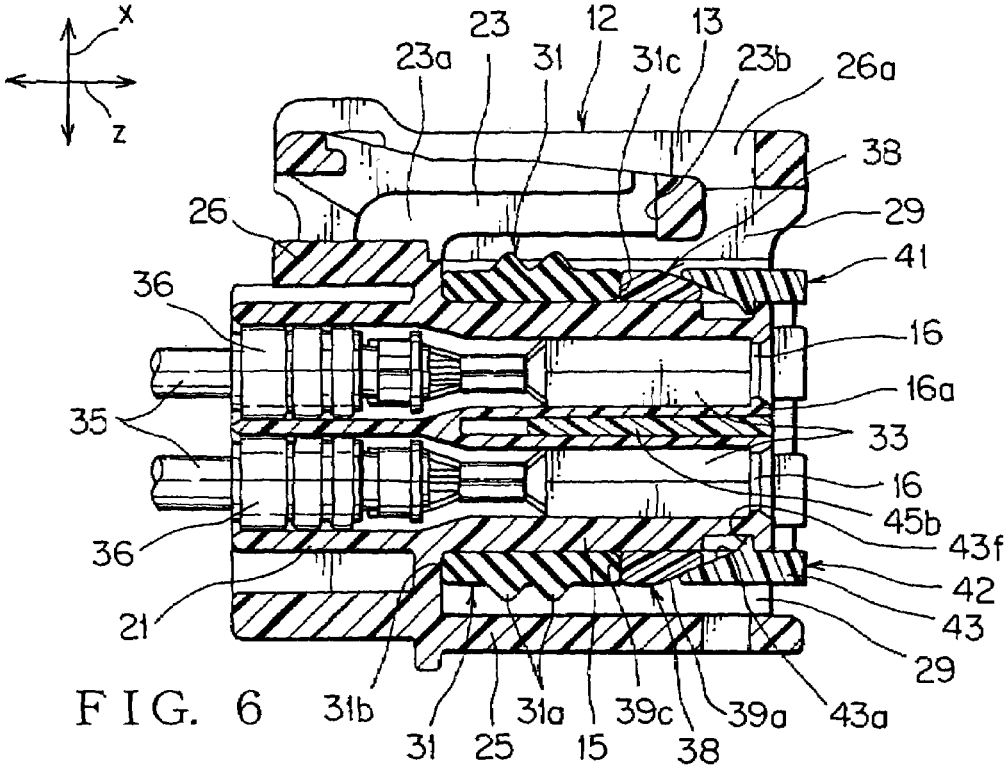
FIG. 6 is a sectional view showing a male connector housing of the connector illustrated in FIG. 5.

Next, a process for assembling and coupling of the vibration resisting connector 100 will be discussed. First, as shown in FIG. 6, the spring packing 31, the inner wedge ring 38, and the outer wedge ring 41 are assembled sequentially into the inner housing 15 of the male connector housing 13. The spring packing 31 may be provided by two-step injection molding when the male connector housing 13 is formed from a resin. The inner and outer wedge rings 38, 41 are slidingly mounted on an outer peripheral surface of the inner housing 15.

Then, the spacer 45 (FIGS. 7 and 9) is assembled into the inner housing 15, while the inner housing 15 has received the female terminal 33 connected to the electrical cable. With the insertion of the spacer 45, its horizontal wall 45*a* moves forward into the deflection space 18 of the terminal locking lance 17 so that the terminal locking lance 17 is locked to surely prevent drawing-out of the female terminal 33. The vertical wall 45*b* has a locking hole 45*c* engaging with an inner wall of the insertion opening 20 to prevent disengagement of the spacer 45.

Figure 9:
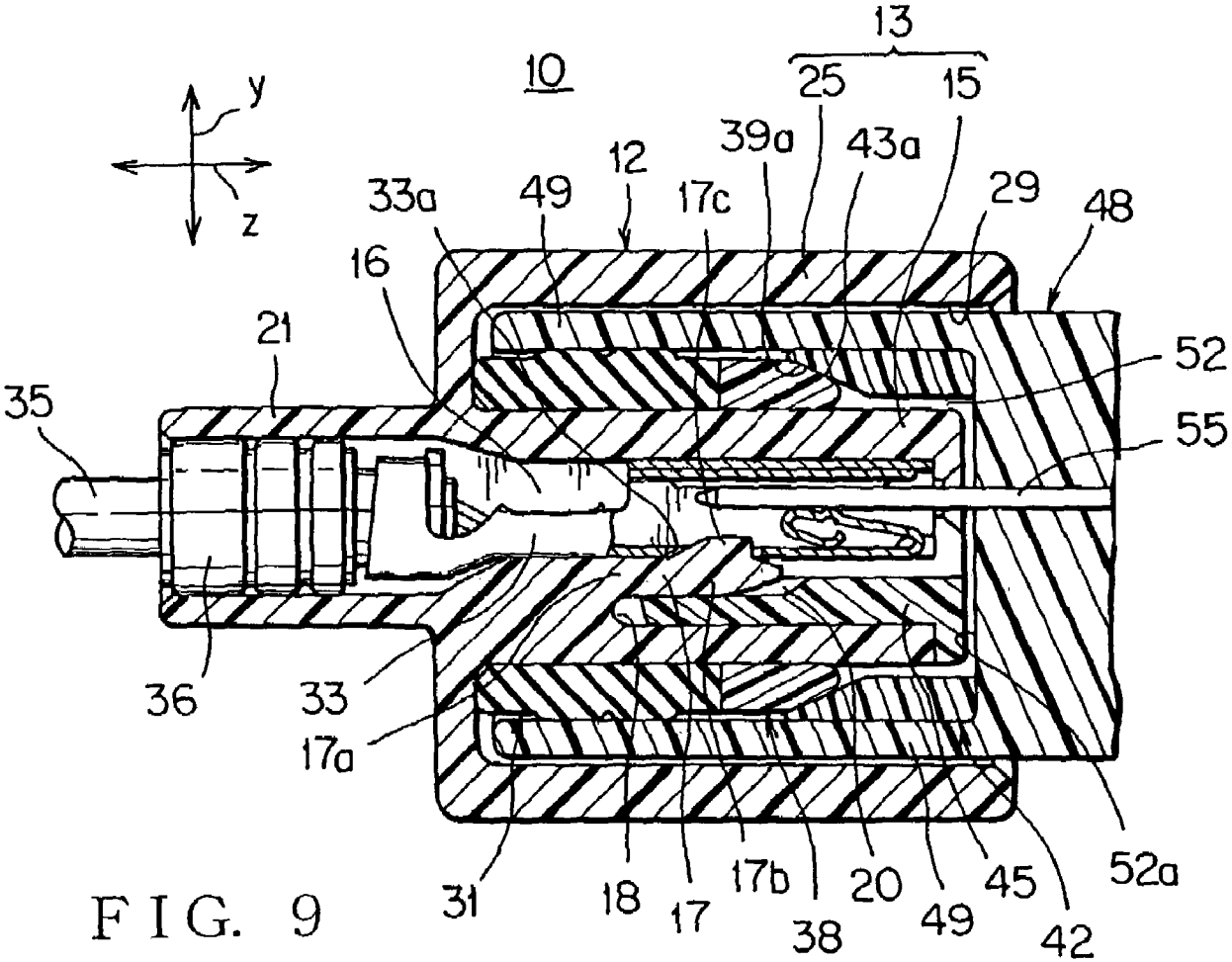
FIG. 9 is a sectional view showing a connection state of female and male terminals received in the connector of FIG. 5.
Figure 10:
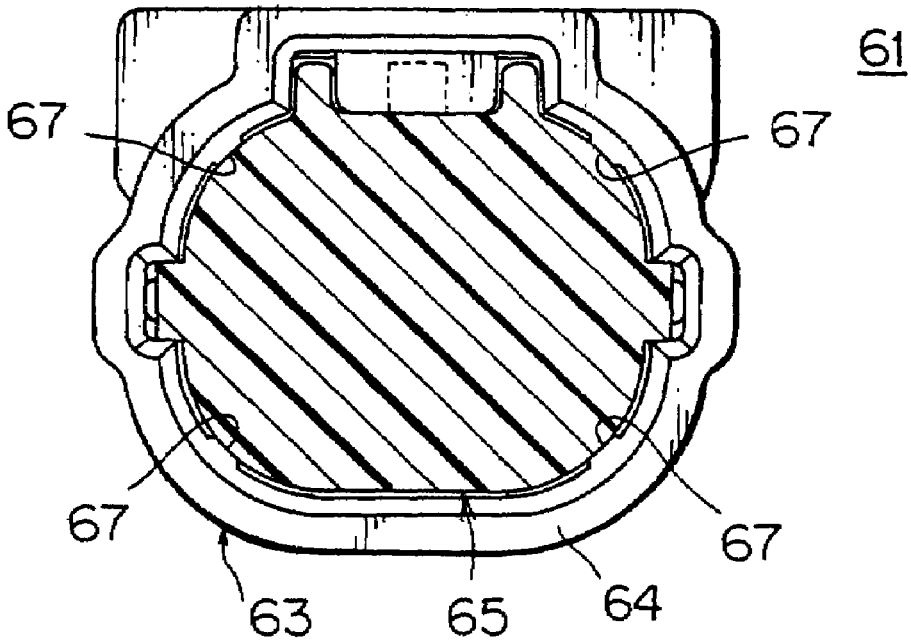
PRIOR ART FIG. 10
FIG. 10 is a sectional view showing an engagement state of connector housings of a conventional connector.
Figure 11:
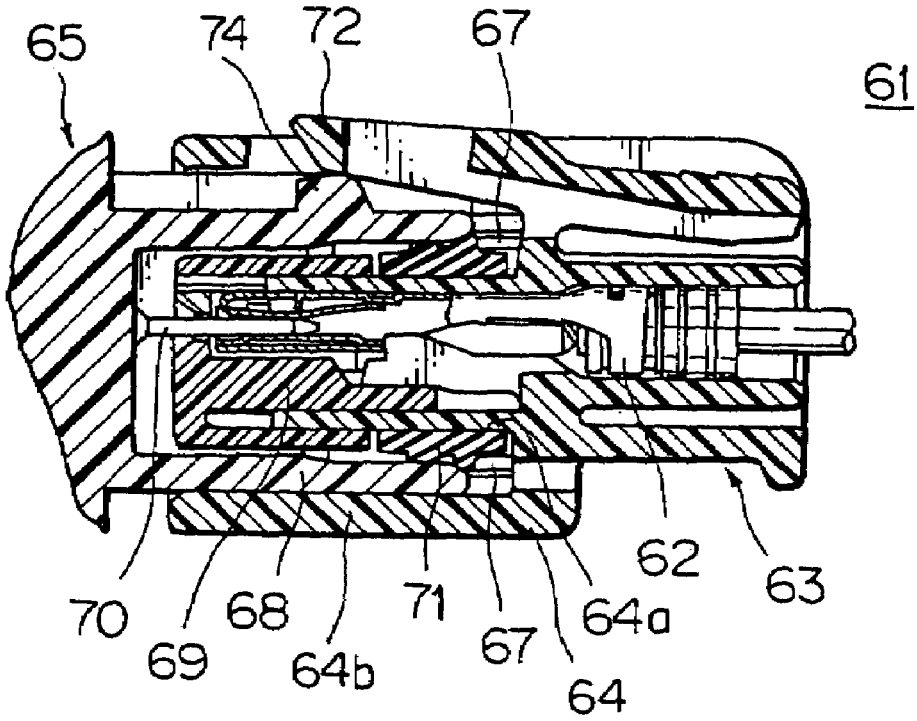
PRIOR ART FIG. 11
FIG. 11 is a sectional view showing a state just before engagement of the connector housings of the conventional connector.

As shown FIGS. 8 and 9, at engagement of the connector housings 13 and 48, the inner housing 15 of the male connector housing 13 is inserted into the connector mating space 52 of the female connector housing 48, and the circumferential wall 49 of the female connector housing 48 moves forward into the generally circumferential clearance 29 defined between the inner housing 15 and the hood 25. Then, the inner wall 52*a* of the connector mating space 52 abuts against the fore end surface 43*c* of the outer wedge ring 41 to push the wedge ring 41 inward, so that the outer wedge ring 41 partially rides over the outward tapered surface 39*a* of the inner wedge ring 38. Thus, the inner and outer wedge rings 38, 41 are engaged with each other, and the female and male terminals are connected to each other. The connector housings 13 and 48 keep their engagement by locking of the locking projection 54 of the female connector housing 48 with the locking arm 23 of the male connector housing 13.

In a locking state of the connector housings 13 and 48, the spring packing 31 resiliently abuts against the inner wedge ring 38, and the outer wedge ring 41 partially rides over the inner wedge ring 38 radially. Furthermore, the fore end surface 43*c* of the outer wedge ring 41 abuts against the inner wall 52*a* of the connector mating space 52. Thereby, the connector housings 13, 48 engage with each other without a clearance therebetween. This prevents looseness of the connector housings 13, 48 in the longitudinal and lateral directions of the connector, preventing wear of the male and female terminals 33 and 55. Preferably, the spring packing 31 and the outer wedge ring 41 are made of a soft material readily deformable to improve the connector housings 13, 48 in tightness, vibration absorption, and waterproofness, electively preventing wear and corrosion of the female and male terminals 33, 55.

This embodiment employs the female connector body 47 that is directly secured to an instrument, but a conventional wiring harness connector may be used alternatively. Furthermore, the inner wedge ring 38 may have an inward tapered surface while the outer wedge ring 41 has an outward tapered surface instead of the outward tapered surface 39*a* of the inner wedge ring 38 and the inward tapered surface 43*a* of the outer wedge ring 41.

The looseness prohibiting member is not limited in a ring but may be configured in various shapes. Instead of the spring packing 31, the inner wedge ring 38 may be made of a soft material with a waterproof function. The inner and outer wedge rings 38, 41 may be mounted in the female connector housing 48 instead of in the inner housing 15 of the male connector housing 13. Only one of the tapered surfaces 39*a*, 43*a* of the inner and outer wedge rings 38 and 41 may be provided.

What is claimed is:

1. An electrical connector comprising:

a first connector housing, a second connector housing mating with the first connector housing, a looseness inhibiting member composed of a plurality of engagement pieces joined together with joining pieces mounted in the first connector housing, a resilient member in the form of a tube and disposed in the first connector housing between the looseness inhibiting member and the second connector housing, wherein a tapered surface is formed in each of an inner wall of the first connector housing and a rear end of the looseness inhibiting member, wherein the looseness inhibiting member is positioned between the first and second connector housings when the first and second connector housings are mated with each other, and the second connector housing pushes the looseness inhibiting member inward into the first connector housing so that the tapered surfaces of the inner wall of the first connector housing and the rear end of the looseness inhibiting member abut against each other upon mating of the first and second connector housings.

2. The connector recited in claim 1 wherein the resilient member is a sealing packing.

3. The connector recited in claim 1 wherein the first connector housing has an inner housing for accommodating a terminal, and the looseness inhibiting member is received in the inner housing.

4. The connector recited in claim 1 wherein the resilient member has a protrusion for preventing disengagement of the resilient member.

5. The connector recited in claim 1 wherein the looseness inhibiting member has resiliency.

6. The connector recited in claim 1 wherein the looseness inhibiting member comprises a plurality of engagement pieces and a plurality of joining piece for joining the engagement pieces, and each engagement piece has a larger width or a larger thickness than that of each joining piece.

7. An electrical connector comprising:

a first connector housing, a second connector housing mating with the first connector housing, a pair of first and second looseness inhibiting members composed of a plurality of engagement pieces joined together with joining pieces are engaged with each other and mounted in the first connector housing, the first looseness inhibiting member positioned outside the second looseness inhibiting member, and a resilient member in the form of a tube and disposed in the first connector housing to abut against the second looseness inhibiting member, wherein a tapered surface is formed in each of the first and second looseness inhibiting members, wherein the first and second looseness inhibiting members are positioned between the first and second connector housings when the first and second connector housings are mated with each other, and the second connector housing pushes the looseness inhibiting members inward into the first connector housing so that the tapered surfaces of the first and second looseness inhibiting members abut against each other upon mating of the first and second connector housings.

8. The connector recited in claim 7 wherein the resilient member is a sealing packing, the packing mounted in the first connector housing.

9. The connector recited in claim 7 wherein the first looseness inhibiting member has a protrusion for preventing disengagement of the first looseness inhibiting member.

10. The connector recited in claim 7 wherein the first connector housing has an inner housing for accommodating a terminal, and the first and second looseness inhibiting members are received in the inner housing.

11. The connector recited in claim 7 wherein at least one of the first and second looseness inhibiting members has resiliency.

12. The connector recited in claim 7 wherein each of the first and second looseness inhibiting members comprises a plurality of engagement pieces and a plurality of joining piece for joining the engagement pieces, and each engagement piece has a larger width or a larger thickness than that of each joining piece.

* * * * *